US009661896B2

(12) United States Patent
Elliott et al.

(10) Patent No.: US 9,661,896 B2
(45) Date of Patent: May 30, 2017

(54) SHOE WITH ELASTICALLY FLEXIBLE EXTENSION

(71) Applicant: Ampla LLC, Long Beach, CA (US)

(72) Inventors: Marcus Elliott, Santa Barbara, CA (US); David Bond, Newbury Park, CA (US)

(73) Assignee: Ampla LLC, Long Beach, CA (US)

( * ) Notice: Subject to any disclaimer, the term of this patent is extended or adjusted under 35 U.S.C. 154(b) by 227 days.

(21) Appl. No.: 14/458,328

(22) Filed: Aug. 13, 2014

(65) Prior Publication Data

US 2015/0047229 A1 Feb. 19, 2015

Related U.S. Application Data

(60) Provisional application No. 61/865,520, filed on Aug. 13, 2013.

(51) Int. Cl.

| | |
|---|---|
| ***A43B 1/10*** | (2006.01) |
| ***A43B 23/22*** | (2006.01) |
| ***A43B 13/12*** | (2006.01) |
| ***A43B 13/18*** | (2006.01) |
| ***A43B 5/06*** | (2006.01) |
| ***A43B 13/04*** | (2006.01) |

(52) U.S. Cl.

CPC ..... *A43B 23/22* (2013.01); *A43B 5/06* (2013.01); *A43B 13/04* (2013.01); *A43B 13/12* (2013.01); *A43B 13/127* (2013.01); *A43B 13/183* (2013.01); *A43B 13/184* (2013.01); *A43B 23/227* (2013.01)

(58) Field of Classification Search

CPC ... A43B 13/181; A43B 13/183; A43B 13/184; A43B 13/127; A43B 13/12; A43B 13/141; A43B 5/06; A43B 23/22; A43B 23/227

USPC ..... 36/31, 76 R, 38

See application file for complete search history.

(56) References Cited

U.S. PATENT DOCUMENTS

| | | | | |
|---|---|---|---|---|
| 75,900 A * | 3/1868 | Hale | A43B 13/183 | 36/28 |
| 1,352,865 A * | 9/1920 | Augestad | A43B 17/00 | 36/136 |
| 1,726,028 A * | 8/1929 | Keller | A63B 25/10 | 36/7.8 |

(Continued)

OTHER PUBLICATIONS

International Search Report and Written Opinion dated Nov. 26, 2014 from related/corresponding PCT Patent Application Serial No. PCT/US2014/050807, filed Aug. 13, 2014.

*Primary Examiner* — Khoa Huynh
*Assistant Examiner* — Katharine Gracz
(74) *Attorney, Agent, or Firm* — Jones Day

(57) ABSTRACT

A footwear article includes a foot-attachment structure configured to attach to a foot, and longitudinally opposite front and rear ends. The footwear article further includes a downward-facing exposed sole surface. A cantilever extension, in a natural condition, adjoins the sole surface at a junction, and projects rearwardly and downwardly from the junction. The extension has a proximal end and a distal end that are longitudinally opposite each other. The extension is supported at only the proximal end. The extension is configured to elastically resist upward rotation of the extension toward the sole, and is configured to be pushed upward toward the sole by the upward force.

16 Claims, 5 Drawing Sheets

(56) References Cited

U.S. PATENT DOCUMENTS 2,357,281 A * 8/1944 Williams ..... A43B 21/30 36/38
2,696,683 A * 12/1954 Ciaio ..... A43B 9/14 36/19.5
2,814,132 A * 11/1957 Montoscuro ..... A43B 21/32 36/37
4,326,313 A 4/1982 Bensley
4,492,046 A * 1/1985 Kosova ..... A43B 13/18 36/27
4,566,206 A * 1/1986 Weber ..... A43B 21/26 36/27
5,159,767 A * 11/1992 Allen ..... A43B 21/32 36/27
5,367,790 A * 11/1994 Gamow ..... A43B 5/06 36/27
5,381,608 A * 1/1995 Claveria ..... A43B 21/30 36/27
5,701,686 A * 12/1997 Herr ..... A43B 5/06 36/27
6,079,126 A * 6/2000 Olszewski ..... A43B 13/141 36/102
6,115,942 A * 9/2000 Paradis ..... A43B 21/30 36/27
6,247,249 B1 * 6/2001 Lindqvist ..... A43B 13/12 36/143
6,374,515 B1 * 4/2002 Davis ..... A43B 13/16 36/103
6,925,732 B1 * 8/2005 Clarke ..... A43B 7/141 36/27
6,928,756 B1 8/2005 Haynes
7,016,867 B2 * 3/2006 Lyden ..... A43B 1/0081 36/37
7,100,308 B2 * 9/2006 Aveni ..... A43B 3/0068 36/144
7,100,309 B2 * 9/2006 Smith ..... A43B 13/181 36/114
7,788,824 B2 * 9/2010 Hann ..... A43B 13/20 36/102
8,056,262 B2 * 11/2011 Lindqvist ..... A43B 13/026 36/151
8,959,797 B2 * 2/2015 Lyden ..... A43B 1/0081 36/27
9,066,559 B2 * 6/2015 Butler ..... A43B 13/386
9,332,805 B2 * 5/2016 Baum ..... A43B 13/183
2003/0051372 A1 3/2003 Lyden
2007/0101617 A1 * 5/2007 Brewer ..... A43B 7/08 36/103
2011/0138652 A1 6/2011 Lucas et al.

* cited by examiner

SHOE WITH ELASTICALLY FLEXIBLE EXTENSION

This claims the benefit of U.S. Provisional Application No. 61/865,520, filed Aug. 13, 2013, hereby incorporated herein by reference.

TECHNICAL FIELD

This relates to athletic shoes, and more particularly to a shoe component that improves stride efficiency.

BACKGROUND

Athletic shoes, such as running shoes, are shoes that are designed to enhance comfort and performance for running and walking.

SUMMARY

A footwear article includes a foot-attachment structure configured to attach to a foot, and longitudinally opposite front and rear ends. The footwear article further includes a downward-facing exposed sole surface. A cantilever extension adjoins the sole surface at a junction, and, in a natural condition, projects rearwardly and downwardly from the junction. The extension has a proximal end and a distal end that are longitudinally opposite each other. The extension is supported at only the proximal end. The extension is configured to elastically resist upward rotation of the extension toward the sole, and is configured to be pushed by an upward force to rotate upward toward the sole.

In one example, the junction location is configured to be under a ball of the foot. The distal end of the extension is located under an arch of the foot. The length of the extension is in the range of 20% to 30% of a length of the foot. A heel of the footwear article is located rearward from the distal end of the extension. The extension is configured to be pushed upward into contact with the sole surface. The extension is configured to position a foot heel at an angle in the range 15-20 degrees from a ground surface.

In one example, the footwear article is a shoe that includes an insole. The shoe includes a semirigid elastically flexible insert. The insert includes a plantar plate that extends along the insole and a thrust plate that extends along the extension. The insert provides elasticity for the extension to elastically resist upward rotation. The plantar plate extends along the insole and includes a location that is under a heel of the foot. The plantar plate supports a big toe of the foot but not other toes of the foot. The plantar plate has an opening located above the thrust plate, the opening being located, sized and shaped to be able to contain the thrust plate if the thrust plate would be rotated upward into the opening. The insert includes an longitudinally-elongated upturn extending upward from a side edge of the plantar plate. A top surface of the thrust plate may be exposed to the outside or embedded within an outsole of the shoe.

DETAILED DESCRIPTION

Figure 1:
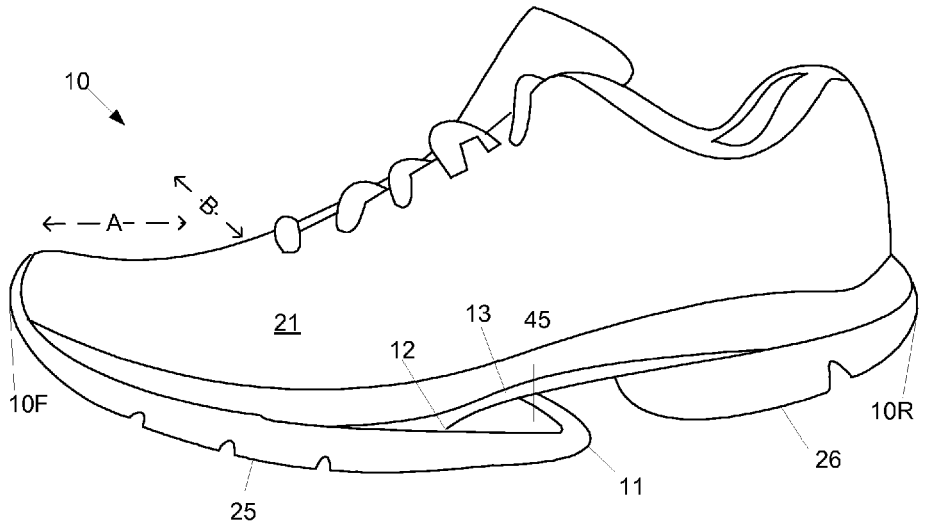
FIG. 1 is a perspective view of an example shoe.
Figure 2:
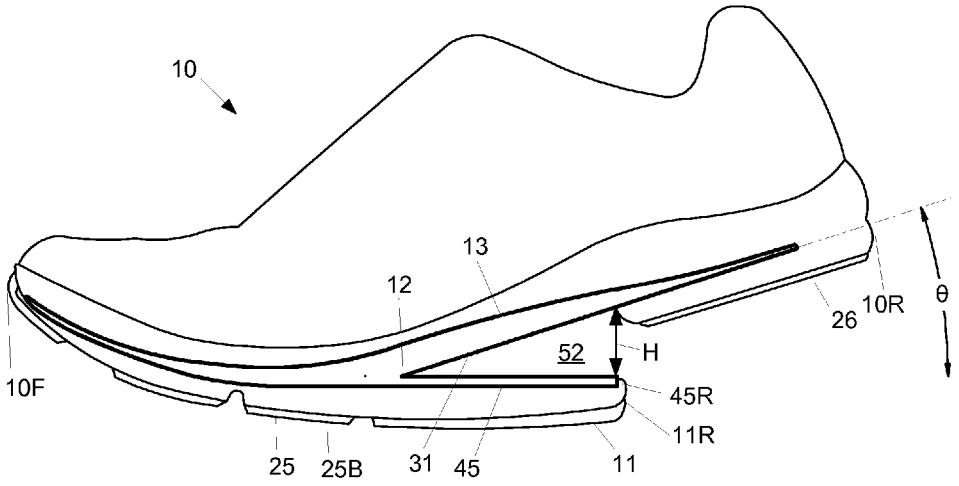
FIG. 2 is a side view of the shoe.

FIGS. 1 and 2 are, respectively, a perspective view and a side view of an example shoe 10. The shoe 10 has a plate-shaped extension 11 that projects at an angle θ downward and rearward from a junction location 12 where the extension 11 joins the shoe sole. The shape and angle θ of the shoe extension are elastically maintained by a semirigid insert 13 that runs along both the shoe sole and the shoe extension. When a wearer (user) of the shoe 10 takes strides, the extension enhances stride efficiency by optimizing proper foot orientation.

The shoe 10 in this example is an athletic shoe in that it is designed for athletic activity. The athletic shoe enhances the wearer's performance and comfort in sporting activities, including running, jumping and walking.

The example shown in the figures is a right shoe for a right foot. A mirror image thereof would be a left shoe for a left foot. The shoe 10 is described below with reference to a longitudinal axis A and a lateral axis B. The shoe 10 has longitudinally opposite front and rear ends 10F, 10R and laterally opposite left and right sides 10L, 10S. For the right shoe in this example, the left side is a "medial" side and the right side is a "laterally outer" side. And vice versa for a left shoe.

Figure 3:
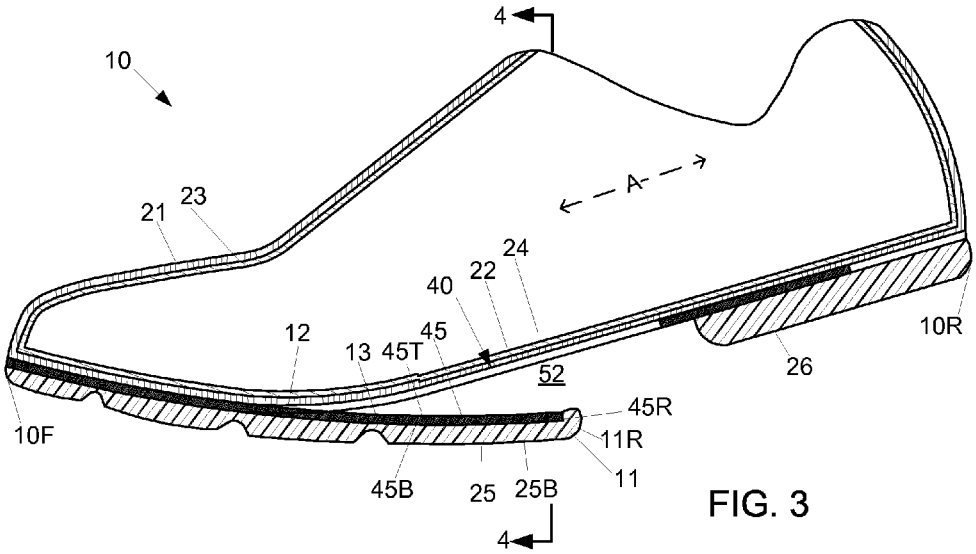
FIG. 3 is a side sectional view of the shoe.
Figure 4:
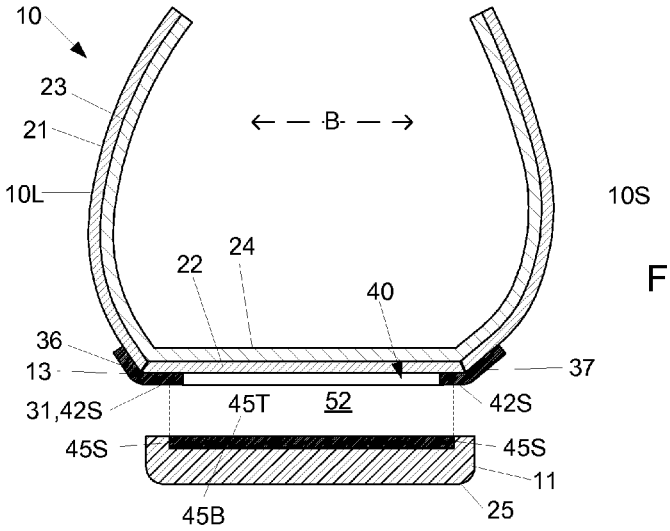
FIG. 4 is a rear sectional view of the shoe, taken at line 4-4 of FIG. 3.

FIGS. 3 and 4 are, respectively, a longitudinal sectional view and a lateral sectional view of the shoe 10. As shown, the shoe 10 includes the following components: An upper 21 comprises a layer, typically of leather or fabric, that covers the top and sides of the foot. The upper may be seam-free and formed of a Thermo Bond upper. The upper extends heel-to-toe (i.e., from a wearer's heel to the wearer's toes). An insole 22 comprises a layer that underlies the foot and extends heel-to-toe. A vertical padding layer 23 underlies the upper. A horizontal padding layer 24 overlies the insole 22. The insert 13 underlies the insole 22. An outsole 25, formed for example of rubber such as elastofoam, underlies a front portion of the insert 13. A front portion of a shoe heel 26 underlies the insert 13, and a rear portion of the shoe heel 26 underlies the insole 22.

FIGS. 5A-5D show the insert 13 in different orientations. The insert 13 comprises a cantilever spring (sprung) component (thrust optimization plate). The insert 13 might comprise a pre-sprung last. The insert 13 is of a material that is semi-rigid and elastically flexible, but substantially inextendible. The insert 13 may be molded as a one-piece unit from an elastically flexible material. The material might be carbon fiber or thermal plastic or combinations thereof. Other example materials include: TPU (thermo-plastic urethane), Pebex plastic, EVA, TPE (thermo-plastic elastomers), polyurethane, silicon, nylon, titanium, solid rubber, and carbon fiber.

The insert 13 in this example is in the shape of a formed plate. Thickness of the plate may be determined based on different parameters, such as: type of sport, shoe size, and the wearer's gender. The plate may have a uniform thickness of 0.1 mm to 5.0 mm.

Figure 5A:
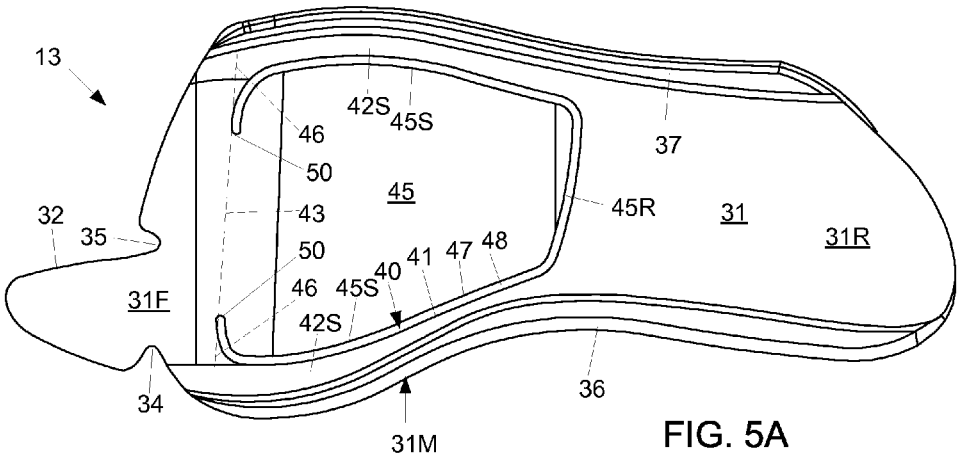
FIG. 5A is a top view of an insert of the shoe.
Figure 5B:
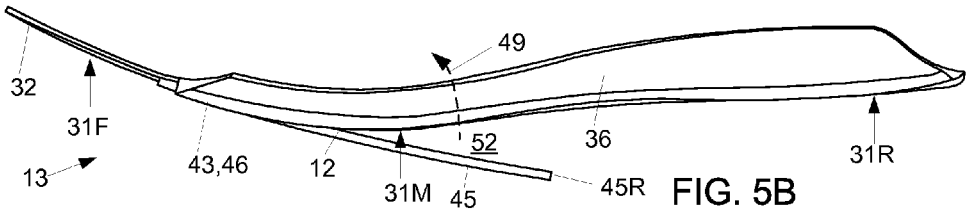
FIG. 5B is a left side view of the insert.
Figure 5C:
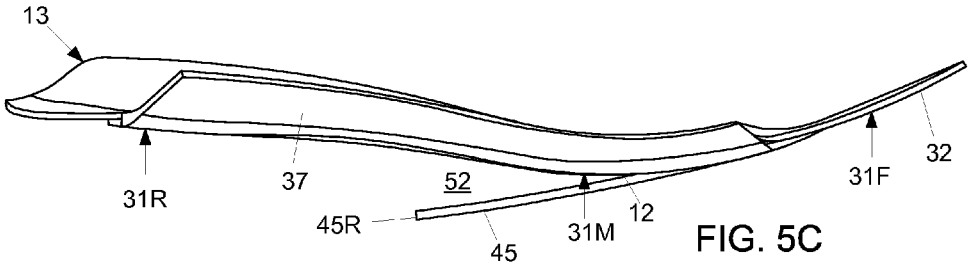
FIG. 5C is a right side view of the insert.
Figure 5D:
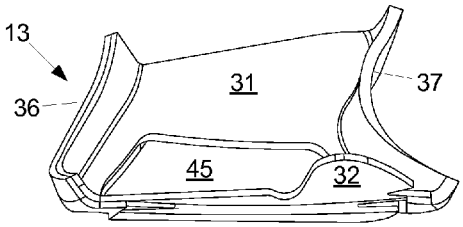
FIG. 5D is a front view of the insert.

The insert 13 includes the following components:

A plantar plate 31 of the insert 13 is a plate upon which the foot rests. The plantar plate 31 includes a front section 31F that underlies the forefoot (including ball and toes of a foot), a mid section 31M that underlies the midfoot (including the arch), and a rear section 31R that underlies the rearfoot (also called hindfoot, including the heel of a foot). The plantar plate 31 underlies the insole 22, and extends rearward from the front 10F of the shoe 10. The plantar plate 31 may extent to a location under the foot heel and even all the way to the rear end 10R of the shoe 10. The rear section is substantially flat (planar). The insert's front and mid sections 31F, 31M are curved, in that their bottom respective bottom surfaces are convex when viewed from the side (FIGS. 5B and 5C).

The front section 31F includes a toe plate 32 that underlies the big toe, and that has a periphery that simulates the outline of the big toe. The insert 13 lacks a portion that would underlie the other toes of the foot. This provides elastic semirigid support preferentially for the big toe. At the rear of the toe plate is a laterally extending left (medial) notch 34 and a rearwardly-extending right (laterally-outer) notch 35.

A left (medial) upturn 36 is a longitudinally-elongated section, of the insert 13, that extends upward from a left (medial) edge of the plantar plate 31. Similarly, a right (laterally-outer) upturn 37 extends upward from a laterally-outer edge of the plantar plate 31. The upturns 36, 37, being substantially perpendicular to the plantar plate 31, stiffen (add rigidity to) the plantar plate 31. The height of each upturn 36, 37 may be in the range 3 mm to 3 cm. The longitudinally-extending length of each upturn 36, 37 may be over 50% of the length of the foot. A front end of each upturn 36, 37 may be at a location that is alongside the ball of the foot or forward from the ball of the foot. A rear end of each upturn 36, 37 may be at a location alongside the foot heel or rearward from the foot heel. In this example, each upturn 36, 37 has a laterally-inner surface that is adhered to the shoe upper 21 and a laterally-outer surface that is exposed to the outside.

An opening 40 in the mid section 31M extends longitudinally from the front section 31F to the rear section 31R. The opening 40 is bounded by an edge 41 in the mid section 31M. The edge 41 is separated from the medial upturn 36 and the laterally-outer upturn 37 by respective longitudinally-extending strips 42S of the mid section 31M. FIG. 5A shows imaginary boundary lines 43 between the front and mid sections. As viewed from the side (FIGS. 5B and 5C), the front section 31F appears as a smooth continuation of the mid section 31M, and vice versa, due to lack of an abrupt change in angle or curvature at the boundary 43.

A thrust plate 45 projects rearwardly from the front section 31F. FIG. 5A shows an imaginary boundary line 46 between the front section 31F and the thrust plate 45. As viewed from the side (FIG. 5B), the thrust plate 45 appears as a smooth continuation of the front section 31F due to lack of an abrupt change in angle or curvature at the boundary 46. A distal (rear) end 45R of the thrust plate 45 in this example is located below the arch of the foot and forward from the shoe heel 26.

As the mid section 31M and the thrust plate 45 extend rearwardly away from the front section 31F, they diverge from each other. That is because, as viewed from the side (FIGS. 5B and 5C), the thrust plate 45 has the same minor upward curvature as the front section 31F, whereas the mid section 31M curves (arrow 49) more sharply upward. Alternatively, the front section 31F and/or the thrust plate 45 may be substantially planar (with no curvature).

A peripheral edge (periphery) 47 of the thrust plate 45 is the same shape as, but slightly smaller than, the edge 41 of the opening 40. Accordingly, when viewed from above (FIG. 5A), the thrust plate 45 appears as if formed by (and may in practice be formed by) cutting a slit 48 in the mid section and then bending (bowing) the mid section 31M upward (arrow 49 in FIG. 5B). The slit 48 has two end points 50 that are laterally-spaced apart. Accordingly, the opening 40 is located above the thrust plate, and the opening is located, sized and shaped to be able to contain the thrust plate 45 if the thrust plate 45 would be rotated about the junction (vertex) 12 upward into the opening 40.

Referring to FIGS. 3-4: In this example, the outsole 25 extends rearward from the front of the shoe 10 to a distal end 11R slightly beyond the rear (distal) end 45R of the thrust plate 45. The outsole 25 covers the thrust plate's bottom surface 45B, rear (distal) surface 45R and laterally opposite surfaces 45S. A top surface 45T of the thrust plate 45 is exposed and faces a section of the insole 22 that is exposed through the opening in the insert 13. The mid section strips 42L, 42S of the insert 13 underlie the insole 22 and has a bottom surface that is exposed to the outside. The upturns 36, 37 of the insert 13 cover the upper 21, and have respective laterally-outer surfaces that are exposed to the outside.

In the natural condition of the shoe 10, as viewed from the side (FIG. 2), the extension 11 diverges from the insole 22 by an angle θ. This angle θ may be in the range 15 to 20 degrees, and leaves a wedge-shaped space 52 between the extension 11 and the insole 22. The space 52 extends rearward from a vertex 12, at the junction between the extension 11 and the insole 22, to the extension's rear end 11R. The junction 12 is below the ball of the foot, and is where the extension 11 adjoins the insole 22 and diverges from the insole 21. The space 52 has a height H (at the extension's rear end 11R) that decreases with increasing flex of the insert 13. Flexural elasticity, provided by the combination of the insert 13 and the outsole 25, resists rotation (movement) of the extension 11 toward the insole 22. Compressive force required to rotate the extension 11 toward the insole 22 is positively related to the decrease in angle θ and inversely related to the angle θ. Forcing the extension 11 all the way to contact the insole 22, thereby reducing both the height H and the angle θ to zero, may require the force against the extension 11 to be in the range two to three pounds.

As viewed from the side (FIG. 2), the outsole's bottom surface 25B follows a smoothly continuous curve, from the shoe's front end 10F to the extension's rear end 11R, due to lack of an abrupt change in angle or curvature at the junction 12. The outsole's bottom surface 25B (FIG. 3) is, as viewed from the side (FIG. 3), convex. This enables any longitudinal location along the outsole's bottom surface 25B to contact the ground to provide ground traction.

Figure 6:
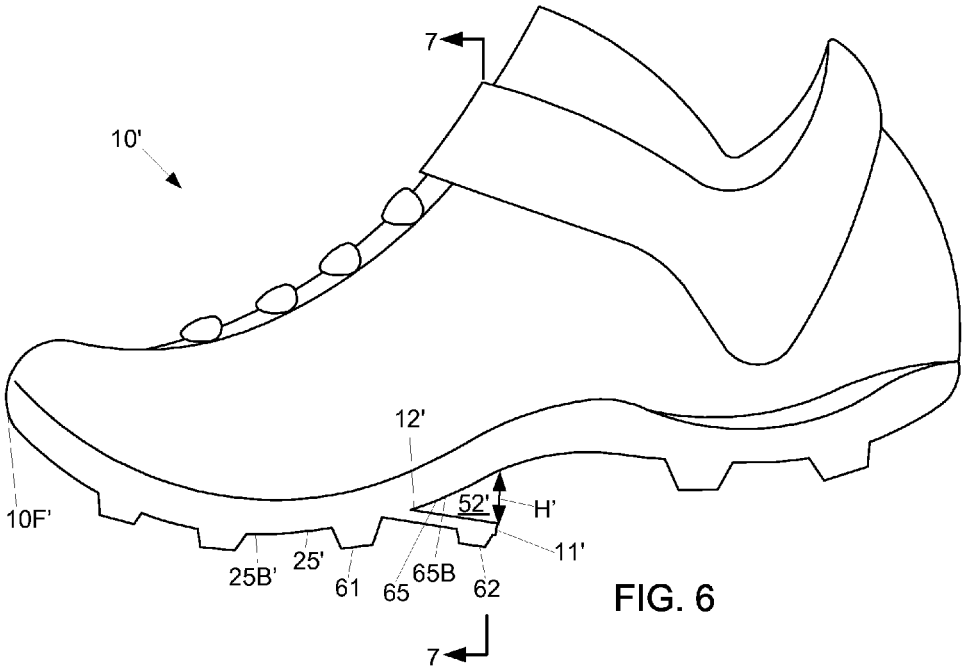
FIG. 6 is a side view of another example shoe.
Figure 7:
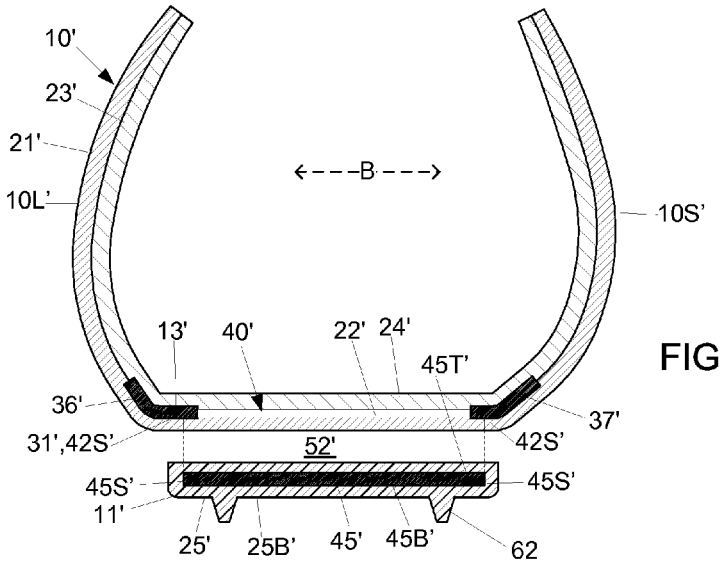
FIG. 7 is a rear sectional view of the other example shoe, taken at line 7-7 of FIG. 6.

FIGS. 6 and 7 are, respectively, a side view and a sectional view of a second example shoe 10', configured for use in soccer and football. Many components of the second shoe 10' correspond to components of the first shoe 10. These components are, in FIGS. 6-7, assigned primed reference numerals that match unprimed reference numerals assigned to the respectively corresponding components in FIGS. 1-5.

The second shoe 10' (FIGS. 6-7) differs from the first shoe 10 (FIGS. 1-5) in that its outsole 25' has front cleats 61 (downward projections) in front of the extension 11 and rear cleats 62 at the rear (distal) end 11R of the extension 11. This limits, and concentrates, the ground fraction to locations of the cleats 61, 62.

The second shoe 10' (FIG. 7) differs further from the first shoe 10 (FIG. 2) in that its insert 13' is embedded within layers of the shoe 10' and not exposed to the outside. This is explained as follows: The insert's plantar plate 31' is sandwiched between the insole 22' and the horizontal padding layer 24'. The insert's upturns 36', 37' are sandwiched between the shoe's upper 21 and the vertical padding layer 23'. So the plantar plate 31' and the upturns 36,37 will be respectively compressed against the upper 21' and the insole 22' by the user's foot. This compression helps prevent (impedes) the upturns 36', 37' from buckling, which would reduce the ability of the upturns 36', 37' to rigidify the plantar plate 31'. The compression also helps prevent the insert 13' from slipping relative to neighboring components of the shoe 10'. The second shoe's thrust plate 45' is embedded within, and thus encapsulated by, the second shoe's rubber outsole 25', such that all four of its surface 45T', 45B', 45S' are covered. A portion 65 of the outsole 25' of the second shoe 10' underlies the plantar plate's mid and rear sections so that they are not exposed.

A sole surface is herein defined as a downward-facing surface, of footwear, that is exposed to the outside. That would include, in the first shoe 10 (FIGS. 1-5), the bottom surface 25B of the outsole 25 and the bottom surface of the portion of the insole 22 that is exposed through the opening 40 in the insert 13 and also the bottom surface of the exposed portions 42L, 42R of the plantar plate 31. That would also include, in the second shoe 10' (FIG. 6-7), the bottom surface 25B' of the outsole 25' and the bottom surface 65B of the outsole extension 65 that faces the extension 11.

In operation, flexibility of the extension 11 enables the extension 11 to flex toward the sole when the foot approaches the ground. Later, as the foot heel rises, elasticity of the extension 11 (which is substantially or primarily provided by the insert 13) urges the extension 11 to flex back to its natural (as-molded, natural) shape. The flexing may be at the vertex 12 or along the length of the extension 11 (thrust plate) or a combination of both.

The extension 11 and its thrust plate 45 are cantilevered. That is because they are anchored and supported at only their proximal end, located at the vertex 12 (junction), and not supported or anchored at their distal end 11R, 45R. The cantilever configuration tends to elastically rotate the shoe insole 21 and foot sole upward to raise the foot heel and shoe heel. The proximal end 12, of both the extension 11 and the extension's thrust plate 45, may be located below the ball of the foot. The extension's and thrust plate's distal ends 11R, 45R may be located below the arch of the foot. The length of the cantilever (extension 11 or thrust plate 45), from proximal end 12 to distal end 11R, 45R, may be in the range of 20% to 30%, such as 25%, of the length of the shoe and/or of the length of the foot.

The insert 13 has been engineered to specifications revealed by the scientific analysis of elite athlete movements and thereby benefits the athlete by optimizing proper push-off position in the running stride.

Push-off efficiency is improved by the extension 11, 11' providing the wearer with a tactile (proprioceptive feedback) indication to pre-set the foot in an optimal thrust position with the foot heel raised above the ground. In the optimal position, the foot sole may be angled at about 15-20 degrees from horizontal, which may be the angle at which the extension 11 diverges from the insole 22. The extensions 11, 11' in these examples give the wearer a physical sensation of how properly the foot is striking the ground. If the foot is not oriented properly, the extension 11 strikes the ground, providing discomfort to the wearer or at least a tactile indication that the foot orientation is improper. Landing on or near the ball of the foot is more efficient than landing on the foot heel. The proper foot orientation caused by the extension 11, in both landing and push-off, provides foot movement that is faster and more efficient. The proper foot orientation caused by the extension 11 also reduces stress on the user's body and helps absorb and release elastic strain energy during running and jumping.

The extension 11 can improve efficiency also by increasing contact area, and thus traction, between the shoe and the ground (running surface). That is because the outsole's bottom surface 25B may remain in contact with the ground even when the foot is tilted upward with foot and heel raised.

Figure 8:
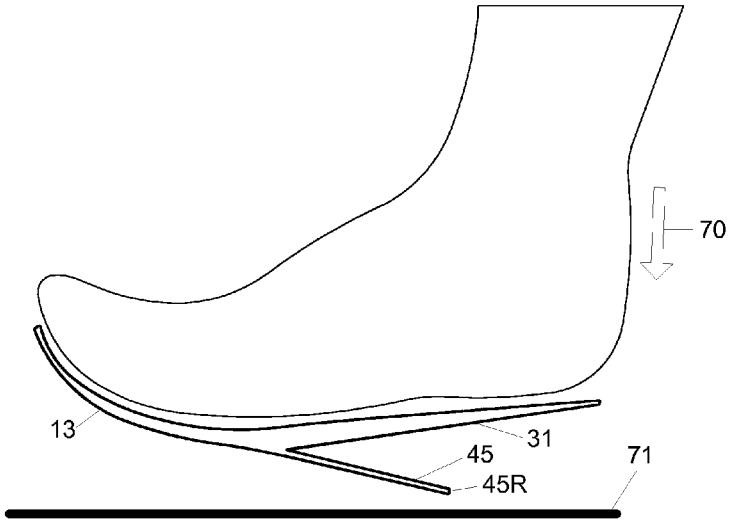
FIG. 8 illustrates a relationship between the insert and the wearer's foot.

FIG. 8 shows a relationship between the insert 13 and the foot in a landing phase of a normal stride, with other shoe components omitted for clarity. The foot is being lowered (arrow 70) to the ground 71, the foot is dorsi-flexed with toes raised. So the foot presses the distal (rear) end 45R of the thrust plate 45 against the ground. This causes the thrust plate 45 to elastically rotate and/or flex upward toward the plantar plate 31.

Figure 9:
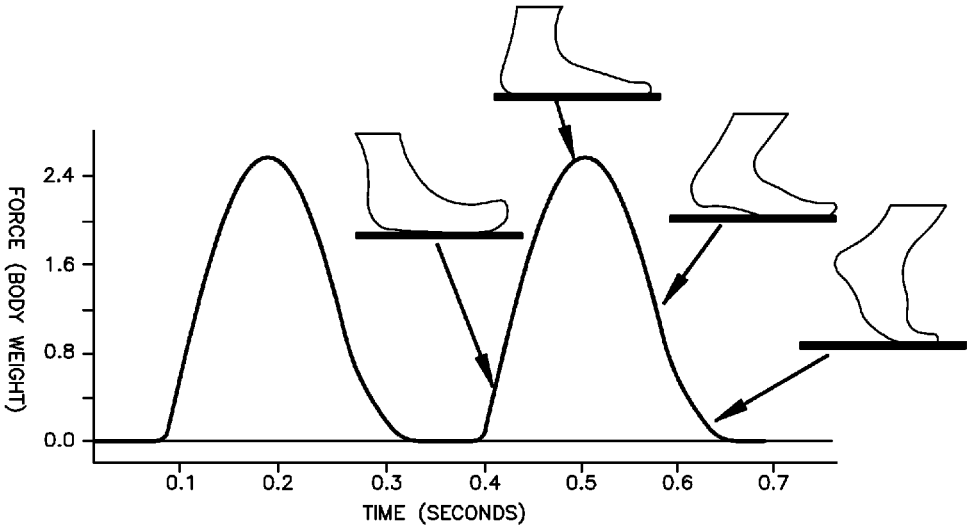
FIG. 9 is a graph of elastic force applied by the insert versus time during a stride.

FIG. 9 is a graph of elastic force applied by the extension 11 versus time during a stride. The graph includes diagrams showing foot position at different points in the stride.

The insert 13 is described above with reference to shoes, in that a shoe secures the insert 13 to the foot. However, other footwear (article worn on a foot) may be used to secure the insert 13 to the foot. Examples are sandals and straps. For example, the insert 13 of FIG. 8 may be simply strapped to the sole of the foot of FIG. 8. The thrust plate 45 may be totally exposed, without an outsole covering, such that the thrust plate 45 itself constitutes the entire extension 11. In such a case, the thrust plate 45 itself contacts the ground.

In the above example, the shoe's upper 21 and insole 22 together comprise a foot-attachment structure that attaches (secures itself) to the foot. Attachment structures of footwear other than shoes may have other configurations (i.e., other than based on an upper or insole) for attachment to a foot. In each case, the insert 13 is secured to the foot by the attachment structure of the respective footwear article.

A functional description of each section of the insert 13 is as follows:

The insert's mid section 31M and rear section 31R together comprise a heel accelerator (HA) lever. The lever is located under the foot's heel (calceanous) bone. The lever elastically returns to its natural position when the wearer has shifted weight forward and starts to push against ground. The angle between the LRM support (below) and the lever might be for example 15-20 degrees. This results in the lever being at a 15-20 degree angle (from horizontal) when the insert 13 is not compressed by the wearer.

The medial upturn 36 serves as a medial radius metatarsal (MRM) support. The MRM support provides metatarsal support and enhances lateral push-off by providing a rigid guard-rail for the foot and acts as one of two spring arms (upturns) for the HA lever. The MRM support may surround the foot and create rigidity around perimeter of foot, thereby enhancing lateral push-off by providing a rigid guard rail for the foot. The MRM support provides a portion (e.g., 50%) of the force that elevates the heel above the ground, by acting as one of two spring arms for the HA lever. The remaining (e.g., 50%) contribution to elevating the heel comes from lateral LRM support (described below).

The laterally-outer upturn 37 serves as a lateral radius metatarsal (LRM) support 5. The LRM support enhances lateral movement by providing a rigid guard rail for the foot and, together with MRM support, acts as one of two spring arms for the HA lever that provides a portion (e.g., 50%) of the heel elevation force.

The thrust plate 45 serves as a plantar (arch) thrust optimization (PTO) wing. The PTO wing gives the shoe a unique heel-raised posture. The PTO wing urges the wearer's foot sole to be inclined with the foot heel raised, as would occur with a high-heeled shoe but without a high heel. The PTO wing provides ground contact target for the athlete. The PTO wing acts as a secondary momentum-enhancing spring that reinforces proper thrust-phase foot positioning through proprioceptive (tactile) feedback, in that the force imparted by the PTO wing and felt by the wearer causes the wearer to tend to orient his/her foot in a configuration (orientation and angle,) that is optimal for push-off.

The toe plate 32 serves as a distal extension (DE) spring, which is a distal (big toe) push-off plate. The DE spring serves as a separate leaf spring for the big toe.

The laterally extending medial notch 34 of the toe plate serves as a metatarsal phalangeal flex (MPF) notch. The MPF notch is aligned with meta-tarsal/phalangeal joint in the foot. The MPF notch isolates the big toe, which is the joint that provides most thrust, thereby providing independent and efficient push-off from the ground. The MPF notch also provides flexibility for the shoe and prevents the insert from breaking.

The rearwardly-extending laterally-outer notch 35 serves as a distal isolation flex (DIF) notch. This DIF notch allows for distal (big toe) isolation and enhances thrust-phase push-off. The DIF notch, the MPF notch and the DE spring function concertedly to isolate the big toe from the rest of the wearer's foot.

The components and procedures described above provide examples of elements recited in the claims. They also provide examples of how a person of ordinary skill in the art can make and use the claimed invention. They are described herein to provide enablement and best mode without imposing limitations that are not recited in the claims. In some instances in the above description, a term is followed by an alternative or substantially equivalent term enclosed in parentheses.

The invention claimed is:

1. A footwear article comprising:

a foot-attachment structure configured to attach to a foot; longitudinally opposite front and rear ends;

a heel adjacent the rear end;

a downward-facing exposed sole surface located forward from the heel;

a ground-treading cantilever extension that adjoins the sole surface at a junction, and, in a natural orientation, projects rearwardly and downwardly from the junction, the extension having a proximal end and a distal end that are longitudinally opposite each other, wherein the extension includes:

a thrust plate that extends along the extension, and an outsole that covers a bottom surface of the thrust plate and is configured to contact the ground to provide ground traction;

an insole;

a semi-rigid elastically flexible insert that includes (i) a plantar plate that extends along the insole and (ii) the thrust plate that extends along the extension projecting rearwardly from the plantar plate, wherein the insert provides flexural elasticity for the extension to elastically resist upward rotation;

wherein:

the proximal end is at the junction, the extension is supported at only the proximal end, the extension extends rearward from the proximal end to the distal end, the distal end is forward from the heel, the extension is configured to elastically resist upward rotation of the extension from the natural orientation, and is configured to be pushed by an upward force to rotate upward from the natural orientation toward the sole, the plantar plate includes a toe plate that is configured to support a big toe of the foot but not other toes of the foot, the plantar plate has an opening located above the thrust plate, and the opening is an opening in the plantar plate and is located, sized and shaped to be able to contain the thrust plate if the thrust plate would be rotated upward into the opening, and the insert includes a longitudinally-elongated upturn extending upward from a medial side edge and a lateral side edge of the plantar plate, wherein the upturn has a laterally-inner surface adhered to the foot attachment structure and a laterally-outer surface exposed to the outside.

2. The footwear article of claim 1, wherein the junction is configured to be under a ball of the foot.

3. The footwear article of claim 1, wherein the distal end of the extension is configured to be under an arch of the foot.

4. The footwear article of claim 1, wherein a length of the extension is in the range of 20% to 30% of a length of the foot.

5. The footwear article of claim 1, wherein the extension is configured to be pushed upward to contact the sole surface which is located forward from the heel.

6. The footwear article of claim 5, wherein a force required to push the extension up to the sole surface is in the range of 2 to 3 pounds.

7. The footwear article of claim 1, wherein the extension is configured to position a foot heel at an angle in the range 15-20 degrees from a ground surface.

8. The footwear article of claim 1, wherein the footwear article is a shoe.

9. The footwear article of claim 8, wherein the plantar plate includes a section that us configured to be under a heel of the foot.

10. The footwear article of claim 1, wherein the upturn has a laterally-inner surface adhered to the foot attachment structure and a laterally-outer surface exposed to the outside.

11. The footwear article of claim 1, wherein the upturn is sandwiched between layers of the shoe.

12. The footwear article of claim 1, wherein the upturn has a front end that is alongside and forward from a ball of the foot, and has a rear end that is alongside and rearward from a heel of the foot.

13. The footwear article of claim 1, further comprising a cleat extending downward from the extension at a rear end of the extension.

14. The footwear article of claim 8, wherein a top surface of the thrust plate is exposed to the outside.

15. The footwear article of claim 8, wherein the thrust plate is embedded within an outsole of the shoe.

16. The footwear article of claim 1, wherein the plantar plate including the toe plate is configured to underlie the big toe and has a periphery that simulates an outline of the big toe.

* * * * *